United States Patent [19]

Bäing et al.

[11] 4,058,069

[45] Nov. 15, 1977

[54] PROCESS AND APPARATUS FOR INCINERATING SUBSTANCES IN A FLUIDIZED THERMAL REACTION FURNACE

[75] Inventors: Helmut Bäing, Dortmund; Gerd Oberschachtsiek, Holzwickede; Horst Grenzing, Wegberg-Beeckerwald; Peter Meurer, Herdecke-Ende, all of Germany

[73] Assignee: Friedrich Uhde GmbH, Dortmund, Germany

[21] Appl. No.: 634,079

[22] Filed: Nov. 21, 1975

[30] Foreign Application Priority Data

Dec. 3, 1974 Germany ..... 2457029

[51] Int. Cl.[2] ..... F23D 19/02; F23G 5/00; F23G 7/04

[52] U.S. Cl. ..... 110/8 F; 23/277 R; 110/28 J; 423/DIG. 16; 432/15; 432/58

[58] Field of Search ..... 23/277 R; 423/659 F; 432/15, 58; 110/8 F, 28 J

[56] References Cited

U.S. PATENT DOCUMENTS

| | | | |
|---|---|---|---|
| 3,309,262 | 3/1967 | Copeland et al. | 23/277 R X |
| 3,605,655 | 9/1971 | Warshawsky et al. | 110/8 F |
| 3,799,747 | 3/1974 | Schmalfeld et al. | 23/277 R |
| 3,921,543 | 11/1975 | Menigat et al. | 110/8 F X |
| 3,925,024 | 12/1975 | Hollingsworth et al. | 23/277 R |

FOREIGN PATENT DOCUMENTS

| | | | |
|---|---|---|---|
| 890,986 | 3/1962 | United Kingdom | 110/28 J |

*Primary Examiner*—Joseph Scovronek
*Attorney, Agent, or Firm*—Malcolm W. Fraser

[57] ABSTRACT

A process and apparatus for controlling the temperature of the fluidized bed in a thermal reaction furnace. An igniting flame is directed horizontally and radially at the fuel within the bed in the lower third of the bed above the grate. The ignition burner and fuel pipeline are arranged closely together and enter the furnace through a common fitting or flange. In operation, the ignition flame is ignited before fuel is fed to the fluidized bed.

2 Claims, 1 Drawing Figure

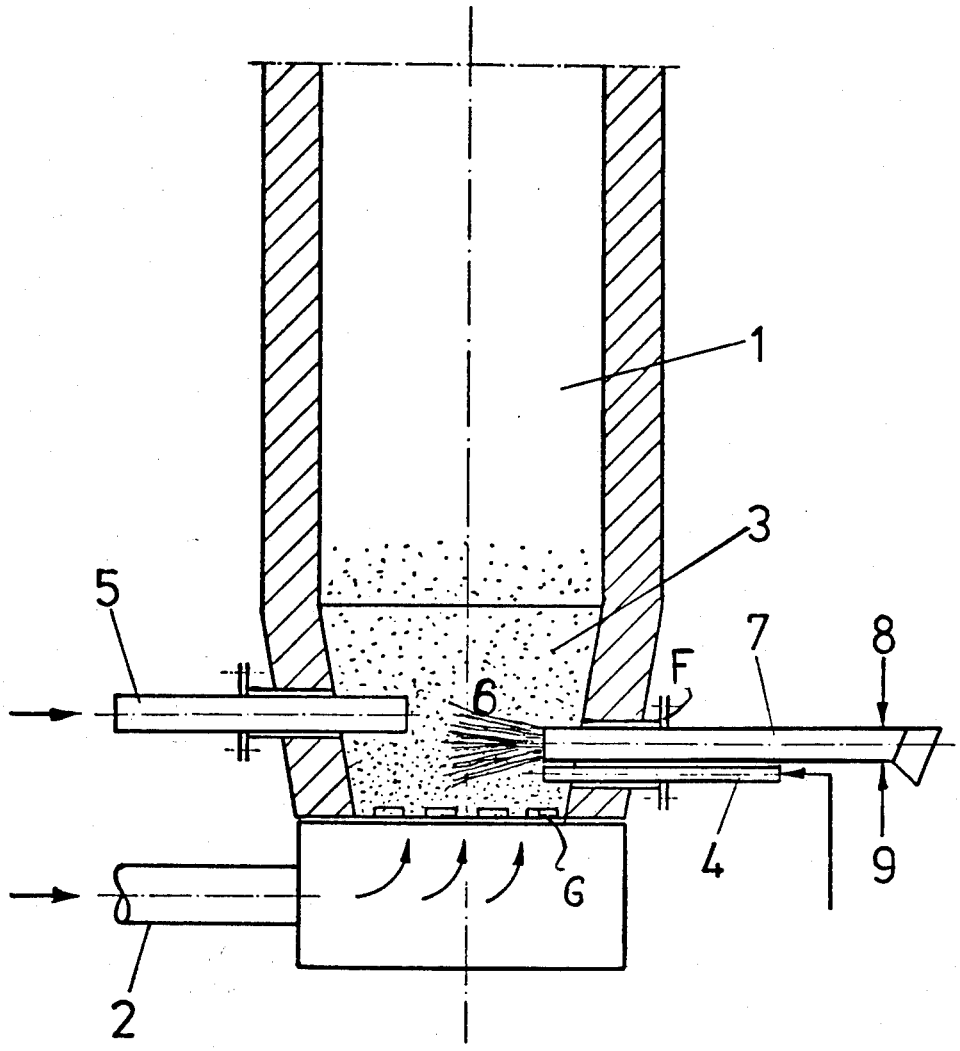
1
3
5
7
8
F
6
4
9
G
2

PROCESS AND APPARATUS FOR INCINERATING SUBSTANCES IN A FLUIDIZED THERMAL REACTION FURNACE

BACKGROUND OF THE INVENTION

The invention concerns a process and apparatus for controlling the temperature of the fluidized bed in a thermal reaction furnace, also known as an incinerator, used for the incineration of liquid, solid or gaseous substances while feeding fuel into the fluidized bed.

When incinerating liquid, solid or gaseous substances, while feeding additional fuel into the fluidized bed of a thermal reaction furnace, there will be a heterogeneous mixture of highly heat-absorbing matter present in the furnace. In order not to interrupt the thermal process, it is necessary to ensure, by employing temperature control, that ignition temperature prevails at one point of the mixture at least. To initiate the thermal process, i.e. when starting up the thermal reaction furnace, it is necessary to heat the fluidized bed to a temperature that is equal to, or higher than, the ignition temperature of the fuel.

In order to achieve complete combustion in fluidized bed incinerators, it is known to maintain a minimum temperature of about 800° C within the incinerator above the fluidized bed by means of a temperature control system. The fluidized bed temperature is subject to certain fluctuations caused by the variation of the combustible material content of the matter to be incinerated. If the fluidized bed temperature should drop below the ignition temperature of the fuel, e.g. when replenishing the incinerator with sand or due to an insufficiency of combustible material, the incinerator combustion process will be disrupted.

As is known from literature, fluidized bed incinerators are relatively sensitive and their control presents certain difficulties.

In order to initiate the thermal process, i.e. to start up a fluidized bed incinerator, it is known to heat the fluidized bed to the necessary temperature by blowing hot gases from above onto the non-fluidized bed, usually consisting of sand. Conventional fluidized bed incinerators are therefore equipped with start-up burners which are arranged in a brick lined duct above the fluidized bed and which slant downwards. Normally, the start-up burner is ignited by a pilot burner with flame scanner. The sand bed is heated solely by the start-up burner which is fired with fuel oil or gas. The air throughput for the fluidized bed is adjusted to a flow rate that is just sufficient to cause fluidization, in order to minimize the loss of thermal energy as a result of heat being carried away by the fluidization air stream, while ensuring that the sand circulation rate is adequate to heat even the lowermost layers of the bed.

When employing this method for preheating the fluidized bed, a substantial quantity of the heat introduced by the start-up burner is unused because it is carried away by the air leaving the fluidized bed in an upward direction. It is not until the ignition temperature of the fuel is reached that fuel is supplied to the fuel feed nozzles. If the sand circulation rate and the supply of heat by the start-up burner should not be properly adjusted to each other, i.e. if too much heat is being supplied and the sand circulation is insufficient, the sand surface temperature will rise to a point where the sand melts. This would result in the formation of solid lumps of sand and the fluidized bed would become inhomogeneous.

Another method of starting up fluidized bed incinerators consists of installing a burner muffle for producing hot gas below the supporting tray for the fluidized bed or outside the incinerator and passing the hot gases through the fluidized bed from below until the fluidized bed is at a temperature that is adequate for igniting the fuel. Both methods and the devices used therefor are expensive, cumbersome and not entirely trouble free.

SUMMARY OF THE INVENTION

The purpose of the invention is to eliminate the disadvantages of the hitherto known methods and devices. This requirement is met by the invention by directing an igniting flame at the fuel within the fluidized bed.

In order to reach the required temperature in the fluidized bed before commencing to feed fuel, a further embodiment of the invention provides for igniting the ignition flame before feeding fuel into the cold fluidized bed. Once fuel is being fed into the preheated fluidized bed, the fuel will likewise ignite and the fluidized bed temperature will then be quickly heated further to the operating temperature.

In order to realize the process according to the invention advantageously, a further embodiment of the invention provides an apparatus in which the ignition burner is arranged within the fluidized bed.

It has been found advantageous to dispose the ignition burner in a horizontal position and radially in the lower third of the fluidized bed.

It is expedient to introduce the ignition burner and the fuel supply into the incinerator through a common flange. This permits the withdrawal of both the fuel supply and the ignition burner from the incinerator by unbolting only a single flange.

The characteristics and advantages of the invention are, in particular, the initiation and maintenance of the combustion of the fuel introduced into the incinerator by bringing the ignition flame into direct contact with the fuel. In the event of fluctuations in the proportion of combustible material in the matter to be incinerated or variations in the depth of the fluidized bed, this system ensures that the temperature of the fuel never drops below ignition temperature, i.e. the incinerator never goes out.

On start-up, the fluidized bed is heated uniformly from below. From the moment of commencing to feed fuel into the incinerator, there is always a self-monitored ignition flame in the fluidized bed. No explosions can occur in the incinerator when using natural or liquefied gas as fuel. By generating the heating gas in accordance with the invention above the incinerator grate and within the fluidized bed, a separate preheating device is not required and the entire heating gas is passed through the fluidized bed.

A further advantage is that the brick lining of the incinerator does not have to be disrupted above the fluidized bed, thus eliminating the adverse effect on the geometry of the hottest part of the incinerator.

BRIEF DESCRIPTION OF THE DRAWING

The FIGURE is a vertical sectional diagrammatic view of a reaction furnace in accordance with the invention.

DESCRIPTION OF THE PREFERRED EMBODIMENT

In an incinerator 1 there is above the grate G a fluidized bed 3 which is kept in fluidized state by feeding combustion air into the incinerator through the pipe line 2. The fluidized bed consists of small granular solid particles, such as sand. The fuel, which serves to maintain the combustion process, is fed into the fluidized bed 3 through a pipe line 4. The liquid, gaseous or solid matter to be incinerated is introduced through a pipe line 5 which is in opposed relation to the pipe line 4. As a result of the high turbulence prevailing in the fluidized bed, the fuel, e.g. fuel gas or oil, is thoroughly mixed. The ignition flame 6 of the ignition burner 7 is located in close juxtaposed relation to the pipe line 4 and ensures that the fuel fed into the fluidized bed is maintained at ignition temperature. The ignition burner 7 and pipe line 4 are disposed horizontally and radially in the lower third of the bed 3, and are introduced into the bed 3 through a common fitting or flange F. Fluctuations in the feed rate of the matter to be incinerated or variations in the depth of the fluidized bed as a result of adding or withdrawing sand have no effect on the ignition or combustion process of the fuel introduced. The ignition burner 7 is supplied with air through a pipe line 8 and with fuel gas through a pipe line 9.

The process according to the invention is further suitable for putting the incinerator into operation. The fluidized bed is kept just above the fluidization point by adding air. The ignition burner 7 is ignited in the cold fluidized bed 3 which is being fluidized by means of air introduced from the pipe line 2. As soon as the ignition flame 6 is burning reliably, the actual fuel, e.g. fuel oil, is added through the pipe line 4.

The fuel and the fluidizing air burn, thus heating the fluidized bed 3 and the incinerator 1. As soon as the fluidized bed has reached the required operating temperature, the liquid, gaseous or solid matter is added through the pipe line 5 and its combustible components are burned in the incinerator.

What we claim is:

1. In a thermal reaction furnace for incinerating substances, the process comprising a. providing a fluidized bed of small, granular, solid particles, b. introducing combustion air to the fluidized bed to keep the bed above the fluidization point, c. igniting a flame before fuel is fed to the cold fluidized bed and directing said flame into the interior of the lower third of the bed, d. delivering to the fluidized bed in opposed relation to said flame substances to be incinerated, and e. feeding fuel to said ignition flame in parallel closely arranged fashion thereto after the ignition flame has burned reliably.

2. A thermal reaction furnace for incinerating substances comprising a. an upright incinerator housing, b. a grate in the lower portion of said housing to support a fluidized bed of small, granular, solid particles, c. means for feeding combustion air through said grate to keep the bed in fluid state, d. means for directing a flame radially of said housing into the interior of said bed in the lower third thereof, e. means in opposed relation to said flame means for delivering substances to be incinerated, and f. means arranged close to and in parallel relation to said flame means for delivering fuel to said flame after it has burned reliably.

* * * * *